US006197044B1

(12) United States Patent
Clayton

(10) Patent No.: US 6,197,044 B1
(45) Date of Patent: Mar. 6, 2001

(54) FEEDING SYSTEM AND APPARATUS FOR INFANTS

(76) Inventor: Eileen A. Clayton, 1912 Alvina Dr., Pleasant Hill, CA (US) 94523

( * ) Notice: Subject to any disclaimer, the term of this patent is extended or adjusted under 35 U.S.C. 154(b) by 0 days.

(21) Appl. No.: 09/436,096

(22) Filed: Nov. 8, 1999

Related U.S. Application Data

(60) Provisional application No. 60/107,761, filed on Nov. 10, 1998.

(51) Int. Cl.[7] ..... A61J 17/00
(52) U.S. Cl. ..... 606/236
(58) Field of Search ..... 606/234, 236, 606/235; 604/77

(56) References Cited

U.S. PATENT DOCUMENTS

| | | | | |
|---|---|---|---|---|
| 2,693,182 | * | 11/1954 | Phillips | 604/77 |
| 4,796,628 | | 1/1989 | Anderson | 128/360 |
| 4,813,933 | | 3/1989 | Turner | 604/79 |
| 5,078,734 | | 1/1992 | Noble | 606/236 |
| 5,146,913 | * | 9/1992 | Khorsandian et al. | 604/117 |
| 5,176,705 | | 1/1993 | Noble | 606/236 |
| 5,512,047 | * | 4/1996 | Dvorak | 606/236 |
| 5,810,000 | * | 9/1998 | Stevens | 604/77 |

* cited by examiner

*Primary Examiner*—Michael Buiz
*Assistant Examiner*—Tan-Uyen T. Ho
(74) *Attorney, Agent, or Firm*—Theodore P. Lopez

(57) ABSTRACT

An improved pacifier configured to facilitate the oral delivery of fluids, such as formula and breast milk, to infants. The improved pacifier may have a pliable nipple usually coupled to a mouth guard. The nipple typically extends outward from a surface of the mouth guard, such that the nipple can be inserted into an infant's mouth to encourage sucking. According to the principles of the present invention, the nipple has an inner lumen which may removably receive a tube, specifically a feeding or medication tube. The tube will generally serve as a passage way for oral fluids entering the digestive system of the infant. Thus, the improved pacifier allows a caregiver to administer medications or feedings without having to first remove the pacifier from the infant's mouth or else having to abstain from using the pacifier during the administration of medication or feedings altogether.

11 Claims, 2 Drawing Sheets

FEEDING SYSTEM AND APPARATUS FOR INFANTS

CLAIM OF PRIORITY

This application claims the benefit of, and priority to, U.S. Provisional Application No.: 60/107,761, filed Nov. 10, 1998, which is herein incorporated by reference for all purposes.

BACKGROUND OF THE INVENTION

1. Field of Invention

The present invention relates generally to a device for administering oral fluids to infants and more particularly, to a pacifier adapted to facilitate the oral delivery of fluids to infants.

2. Related Art

Pacifiers are well known. Generally, pacifiers include a pliable nipple or teat which extends from one side of a guard or shield. The guard is usually contoured to comfortably fit against the area adjacent an infant's mouth. As suggested by the name, traditional pacifiers soothe or "pacify" an infant by providing an oral stimulation or distraction. Pacifiers also aid in the infants digestive and waste elimination processes, by stimulating salivation and peristalsis of the bowel. For these reasons, the use of a pacifier is generally desired and encouraged for both full term and prematurely born infants.

Of significance to the present invention are the special digestive needs of premature infants or "preemies." Premature infants are generally defined as infants born after 36 weeks gestation or younger, and usually 2,000 grams or less. Due to their immaturity and diminutive stature, preemies are often incapable of bottle feeding or breast feeding for several weeks after birth.

Depending on the infant's age, weight, and development state, it may be necessary to initially feed the infant intravenously, using a Dextrose-based solution. Intravenous (IV) feeding is usually necessary until the child's digestive system has developed well enough to sufficiently absorb enough calories to support the infant's dynamic metabolism and at the same time promote growth and weight gain. An intermediate step between IV feeding and normal sucking and swallowing, is gavage tube feeding. This method involves supplying a milk-based formula or breast milk directly to the infant's stomach through a feeding tube which is threaded through the mouth and down the esophagus into the stomach. A bottle bag or syringe of formula is attached to the upper end of the gavage tube. Using the force of gravity, the formula slowly courses through the gavage tube directly into the infant's stomach. Gavage tube feeding is considered superior to IV feeding because it involves the normal digestion of a nutritionally complete formula, and is a natural step toward normal eating.

However, there are drawbacks to gavage tube feeding. For example, gavage tube feedings may tend to impede an infant's progression towards normal sucking and swallowing, since gavage tubes are deployed directly into the stomach of the infant. As a result, an infant's sucking muscles and swallowing reflexes are not exercised. Of course, sucking is important because it is the means by which an infant pulls liquid from a bottle or breast and because it encourages the production of saliva and digestive juices, which help digest the infant's food. Sucking also stimulates peristalsis of the bowel.

Unfortunately, if during a gavage feeding a caregiver wishes to provide an infant with a traditional pacifier, the gavage tube must first be removed. Some caregivers have attempted to rectify this problem by using the pacifier and gavage feeding tube simultaneously. For example, in U.S. Pat. No. 4,796,628 a pacifier is described for use simultaneously with a gavage feeding tube. The pacifier includes a nipple and a guard. The guard has a groove suitable for allowing the tube to be passed through the guard and into the infant's mouth. However, it is difficult for the infant to suck the traditional pacifier with the feeding tube in place because the tube passing down the side of the nipple of the pacifier interferes with a good seal on the pacifier and prevents proper and constructive sucking.

For these reasons, a pacifier is needed which accommodates gavage tube feedings and at the same time stimulates constructive sucking.

SUMMARY OF INVENTION

The present invention provides a device for administering oral fluids to infants. Specifically, the invention includes an improved pacifier configured to facilitate the oral delivery of fluids, such as formula and breast milk, to infants. The invention includes an improved pacifier, which may have a pliable nipple usually coupled to a mouth guard. The nipple typically extends outward from a surface of the mouth guard, such that the nipple can be inserted into an infant's mouth to encourage sucking. According to the principles of the present invention, the nipple has an inner lumen which may removably receive a tube, specifically a feeding or medication tube. The tube will generally serve as a passage way for oral fluids entering the digestive system of the infant. Thus, the improved pacifier allows a caregiver to administer medications or feedings without having to first remove the pacifier from the infant's mouth or else having to abstain from using the pacifier during the administration of medication or feedings altogether.

The improved pacifier may be used with the gavage tube feeding system. The pacifier can provide comfort to an infant while a tube from the gavage feeding system is passed through the lumen of the nipple into the infant's mouth and subsequently into the infant's throat and stomach. Since the tube enters the infant's mouth through the nipple lumen, the tube does not interfere with the infant's ability to create a good seal on the pacifier. Thus, the infant can receive the benefit of the feeding as well as the beneficial aspects provided by using the pacifier. While the pacifier is in the infant's mouth, the infant's tendency to suck the nipple encourages the infant to swallow. Swallowing during the insertion of the feeding tube helps to reduce the infant's tendency to gag, which makes it easier for a care provider to pass the tube through the throat.

Alternatively, a tube, such as a gavage feeding tube may already be in place in the infant's mouth when the caregiver decides to use the improved pacifier of the present invention. In this alternative example, the end of the feeding tube outside of the patient's mouth may be disconnected from the feeding source and threaded through the nipple lumen, such that the nipple can then be passed into the infant's mouth. The tube end may then be re-connected to the feeding source.

Advantageously, the improved pacifier may be used with other than a feeding tube system. For example, the improved pacifier may be used to administer medications through the tube, particularly viscous solutions, which may otherwise cause choking episodes, which lead to bradycardias. The improved pacifier may also be used to administer charcoal or barium through the tube, to minimize gastric aspiration, and it may be used either as a disposable or reusable unit.

In one aspect of the invention, an improved pacifier is provided which has a nipple and a mouth guard. The improvement includes a nipple which is formed with an inner lumen that extends from a first end to a second end of the nipple. The inner lumen has a first opening at the first end and a second opening at the second end. Thus, a tubular member may be removably received within the inner lumen through either opening. Advantageously, the tubular member includes a gavage feeding tube which may be coupled to a gavage container for the feeding of an infant. The gavage feeding tube may be selected from the group comprising any size tube, preferably a number 5 and/or a number 8 gavage tube.

In another aspect of the invention, an infant feeding system is provided which includes an infant pacifier. The infant pacifier includes a base; and a hollow nipple which is coupled to the base. The nipple has a first end, a second end, and an inner lumen extending from the first end to the second end. Each end of the lumen has an opening which is capable of removably receiving a tubular member. Advantageously, the gavage feeding tube and the infant pacifier can be used simultaneously and the infant pacifier can be inserted and removed from an infant's mouth without disturbing the tubular member. Optionally, the tubular member is a gavage feeding tube which is coupleable to a gavage feeding container.

In yet another aspect of the invention, an improved pacifier is provided having a nipple and a mouth guard. The improvement includes means for accommodating a tubular member in the pacifier. In this aspect, the tubular member and pacifier are capable of being inserted and removed from an infant's mouth without disturbing the tubular member.

In yet another aspect of the present invention, a method is provided for feeding an infant. The method includes selecting a pacifier having a nipple and a mouth guard, the nipple having a first end, a second end, and an inner lumen therethrough and threading a tubular member through the inner lumen. The method may further include coupling the tubular member to a container where the container contains a fluid selected from the group consisting of formula and breast milk or a viscous solution selected from the group consisting of medications, charcoal or barium.

DESCRIPTION OF THE SPECIFIC EMBODIMENTS

Figure 1:
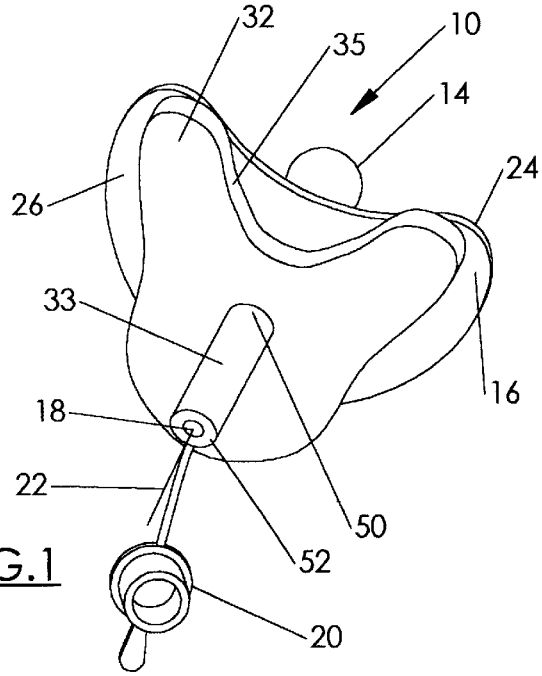
FIG. 1 illustrates a simplified perspective view of a pacifier accommodating a feeding tube according to the principles of the present invention.

FIG. 1 shows a perspective view of a pacifier assembly according to a specific embodiment of the present invention. Although, the invention is described throughout as being sized to be particularly useful with premature infants, the size of the improved pacifier can be made appropriate for micro-preemies, term infants, and pediatrics and still remain within the scope of the present invention. In an exemplary embodiment, pacifier assembly 10 includes nipple 14, guard 16, base 32, and a snap-open cap 20. The components of pacifier assembly 10 are coaxially aligned along central axis 22, and are substantially symmetrical with respect thereto. As described in more detail below, nipple 14 has formed therein nipple lumen 40 (shown in phantom), while base 32 includes tube member 33 with lumen 18 formed therethrough. Nipple lumen 40 and lumen 18 are coaxially aligned to provide a passageway through pacifier assembly 10 and into an infant's mouth for inserting a tube or the like therethrough.

Figure 2:
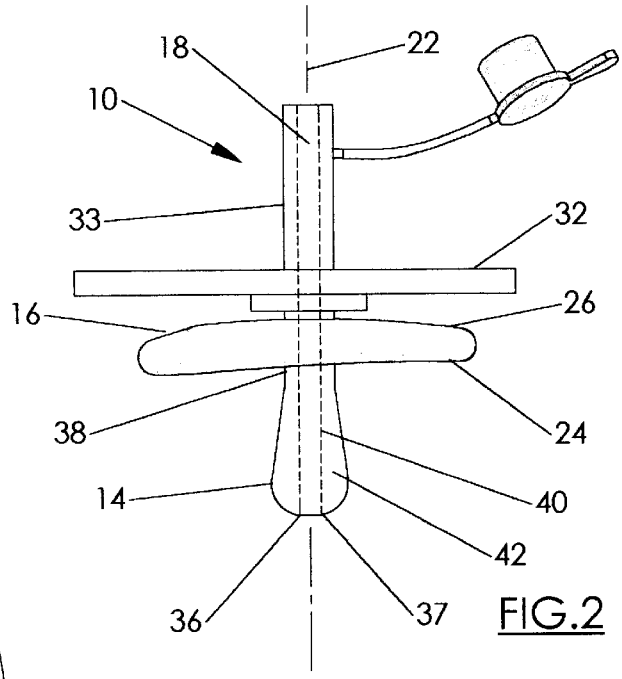
FIG. 2 is a simplified cross-sectional side view of the present invention as illustrated in FIG. 1.

As best illustrated in the cross-sectional view of FIG. 2, guard 16 is disposed generally orthogonal to axis 22. Guard 16 includes a forward surface 24 and an opposed rear surface 26. Forward surface 24 is substantially concave to fit comfortably around an infant's mouth and is generally smooth, but for nipple 14 extending perpendicularly therefrom. Guard 16 may be formed air pervious with a plurality of holes or cutouts so as to not interfere with the infant's breathing. Rear surface 26 has disposed thereon base 32. Base 32 may be formed and shaped into any suitable geometry. Base 32 may be formed with a cut-out 35 to accommodate an infant's nose. Tube member 33 is formed on base 32 and has inner lumen 18 passing therethrough. Lumen 18 commences on a distal end of tube member 33, extends through base 32, and terminates on the forward surface 24 of guard 16. Tube member lumen 18 is a small diameter, hollow lumen, which is capable of removably receiving a small diameter tube or the like. In a preferred embodiment, the lumen is sized to receive a gavage feeding tube, and more preferably a number 5 or a number 8 gavage tube.

Nipple 14 extends from forward surface 24 of guard 16. Nipple 14 is preferably a hollow molded latex rubber or silicone element having an open distal end 36 and an open proximal end 38 with nipple lumen 40 therethrough. Adjacent open distal end 36 is bulb portion 42 which may be orthodontically asymmetrical, but may also be formed into any shape suitable for use by the infant which allows for proper and constructive sucking. Open proximal end 38 defines a termination point of lumen 40. Similar to tube lumen 18, nipple lumen 40 is a small diameter, hollow lumen, which is also capable of removably receiving a small diameter tube or the like, preferably a gavage feeding tube, and more preferably a number 5 or a number 8 gavage tube.

Figure 2A:
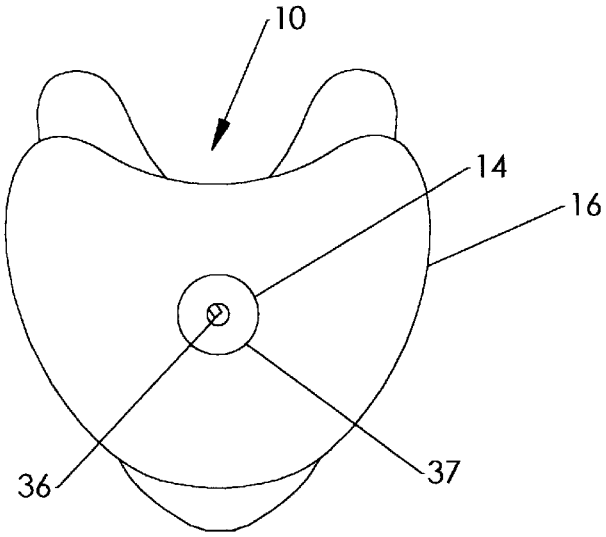
FIG. 2A is a simplified front end view of the nipple of an embodiment of the present invention.

Both nipple lumen 40 and tube lumen 18 are axially aligned as a result of nipple 14 being coupled to guard 16 during the fabrication of pacifier assembly 10. Optionally, open distal end 36 may be formed with a sphincter end 37 as shown in FIG. 2A, which can form a seal about the inserted tube. The seal may prevent leakage of saliva and the like into lumens 18 and 40 and out of tube 33, but will not substantially prohibit axial translation of the tube through lumens 18 and 40.

Figure 3:
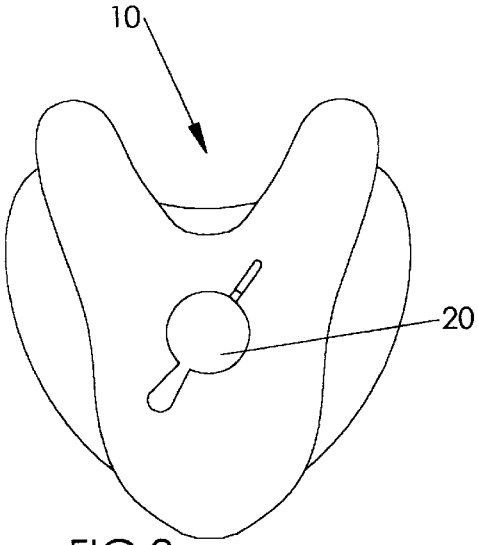
FIG. 3 is a simplified front view of the present invention as illustrated in FIG. 1, utilizing a snap-open cap to provide a closed system, when the system is not being used with a tube.

In the event that during a feeding the tube must be removed, tube 30 is pulled back through lumens 18 and 40, until tube 30 exits pacifier assembly 10. Snap-open cap 20 may be used to cap tube holder 33 as shown in FIG. 3 to seal lumen 18 in order to close pacifier assembly 10, to minimize the undesired ingestion of air during non-nutritive sucking. Alternatively, pacifier assembly 10 may be designed to be a "one-use" device and therefore disposable.

Figure 4:
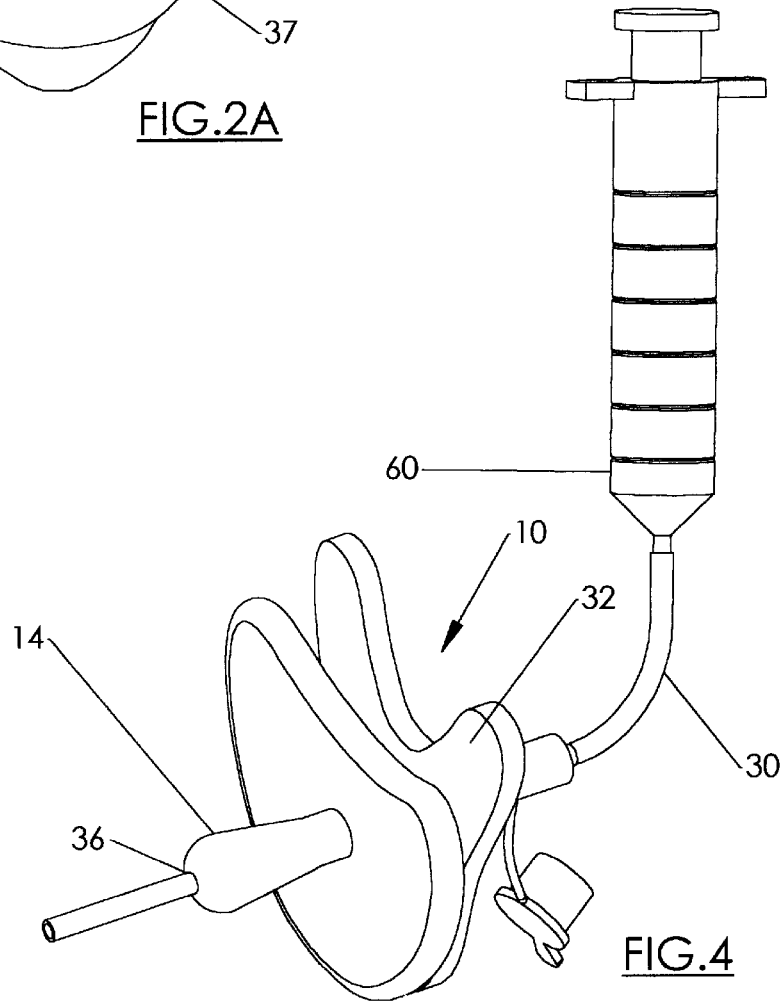
FIG. 4 is a perspective view of the present invention of FIG. 1 in use with a feeding tube and container.

In operation, as shown in FIG. 4, pacifier assembly 10 may be used with a gavage feeding system, which includes a gavage tube 30 and a gavage container 60. Container 60 may be filled with a nutritive fluid, such as formula or breast milk. Optionally, tube 30 may be connected to a reservoir 60 containing medicine, or the like, or a viscous solution including charcoal, barium, vitamins, and lipids.

In one operational embodiment, pacifier assembly 10 may be inserted into the infant's mouth prior to the insertion of tube 30. With pacifier assembly 10 in position, a first end of tube 30 may be threaded through lumens 18 and 40 and into the infant's mouth and subsequently into the infant's stomach. The second end of tube 30 that remains outside the infant's mouth may be coupled to container 60. To remove pacifier assembly 10 from the infant's mouth, while leaving tube 30 in position, tube 30 is disconnected from the reservoir 60 and pacifier assembly 10 is pulled back until tube 30 exits lumen 18. In this manner, tube 30 may remain deployed in the infant's stomach.

In another operational embodiment, a first end of tube 30 is inserted into the throat and subsequently the stomach of an infant. The second end of tube 30, which remains outside the infant's mouth, may then be threaded into pacifier assembly 10. Tube 30 is inserted into opening 36 of nipple 14. Tube 30 is then threaded through the inner lumen of nipple 14 until tube 30 exits pacifier assembly 10 either from a corresponding opening in base 32 or tube holder 33. Tube 30 may then be coupled to gavage container 60 and nipple 14 may be inserted into the infant's mouth.

Those skilled in the art will recognize that modifications and variations can be made to the disclosed embodiments without departing from the subject or scope of the invention. Thus, the invention is not intended to be limited except to the apparatus and method, and equivalents thereof, as recited in the following claims.

What is claimed is:

1. An improved pacifier having a nipple and a mouth guard, the improvement comprising:

a nipple having a first open end with a first self-acting sealing device for providing a seal about a tubular member, a second open end, and an inner lumen formed therebetween, the inner lumen being configured to removably receive a tubular member which provides a passageway for oral fluids entering the digestive system of an infant.

2. An improved pacifier as in claim 1, wherein the tubular member comprises a gavage tube which is couplable to a fluid reservoir.

3. An improved pacifier as in claim 1, wherein the inner lumen can accommodate a gavage feeding tube selected from the group consisting of a number 5, number 7, and a number 8 gavage tube.

4. An improved pacifier as in claim 1, further comprising a snap-cap for capping the inner lumen from an external environment.

5. An improved pacifier as in claim 1, wherein the second open end has a second self-acting sealing device for providing a seal about said tubular member when the tubular member is disposed within the inner lumen.

6. An infant feeding system comprising:

an infant pacifier including:

a base; and a nipple coupled to the base, the nipple having a first end, a second end, and an inner lumen extending from the first end to the second end, each end of the inner lumen defining an opening, at least one of said openings having a self-acting closure, and a tubular member removably receivable in said inner lumen, said tubular member providing a passageway for oral fluids entering the digestive system of an infant.

7. A feeding system as in claim 6, wherein the tubular member is a gavage feeding tube coupleable to a gavage feeding container, wherein the gavage feeding tube and infant pacifier can be used simultaneously.

8. A feeding system as in claim 6, wherein the infant pacifier can be inserted and removed from an infant's mouth without disturbing a placement of the tubular member.

9. A feeding system as in claim 6, further comprising a tube holder extending outward from a rear surface of the base, wherein the tube holder has an inner lumen running therethrough, the tube holder inner lumen being axially aligned with the nipple inner lumen when the nipple is disposed on a forward surface of the base.

10. A feeding system as in claim 6, wherein the tubular member is threadable through the opening at the first end of the inner lumen and the opening at the second end of the inner lumen and into an infant's mouth.

11. A feeding system as in claim 10, wherein the self-acting closure comprises a sphincter for providing a seal about the tubular member.

* * * * *